US007056184B2

(12) United States Patent
Stanier

(10) Patent No.: US 7,056,184 B2
(45) **Date of Patent: *Jun. 6, 2006**

(54) INFLATABLE HUMANOID FORMS

(75) Inventor: John David Stanley Stanier, San Luis Obispo, CA (US)

(73) Assignee: Crowd In A Box Corporation, Grover Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/697,666

(22) Filed: Oct. 29, 2003

(65) Prior Publication Data

US 2004/0087243 A1 May 6, 2004

Related U.S. Application Data

(60) Continuation of application No. 09/940,301, filed on Aug. 27, 2001, now Pat. No. 6,688,940, and a division of application No. 10/368,501, filed on Feb. 15, 2003, now Pat. No. 6,672,933.

(51) Int. Cl.
*A63H 3/06* (2006.01)

(52) U.S. Cl. ..... 446/226; 446/221

(58) Field of Classification Search ..... 446/220, 446/223, 224, 226, 255, 225; 40/407, 412, 40/439, 477, 538, 605, 617; D21/436–440
See application file for complete search history.

(56) References Cited

U.S. PATENT DOCUMENTS 2,027,225 A * 1/1936 Gill ..... 446/226
2,470,990 A * 5/1949 Kennedy ..... 156/145
3,801,403 A * 4/1974 Lucek ..... 156/244.13
5,167,561 A * 12/1992 Rizzo ..... 446/224
5,340,350 A * 8/1994 Fink et al. ..... 446/226
5,682,701 A * 11/1997 Gammon ..... 43/2
6,030,271 A * 2/2000 Pietrafesa ..... 446/226

OTHER PUBLICATIONS 19 pages of color images from an Australian movie entitled "Around the World in 80 Ways", releasted 1987.*
Yahoo Search. E!Online-Movie Facts- "Around the World in 80 Ways", 1988.*
19 pages of color images from an Australian movie entitled "*Around the World in 80 Ways*, " released 1987 (unconfirmed).
Author unknown, "*On the set of Legends of the Fall with "G" Company*," Part 3-Second week on the set; http://www.canadiansoldiers.com/legends3.htm; Jul. 1993-Aug. 1993.
Judy Cameron et al, "*The Art Of Gone With The Wind, The Making Of A Legend*," Prentice Hall Editions, Stated First Edition, 1989, ISBN:0130467405, pp. 97 and 137.

(Continued)

*Primary Examiner*—Bena Miller
(74) *Attorney, Agent, or Firm*—Morrison & Foerster LLP

(57) ABSTRACT

An apparatus comprising one or more inflatable three-dimensional humanoid figures for use in background scenes associated with still photography, motion pictures and video productions which are low in cost, lightweight, easy to use, easy to store, easy to transport and provides a greater range of viewing angles. It is also envisioned that this invention can be used for corporate conventions requiring the illusion of a large number of participants, in advertising and other functions where the illusion of large numbers of people enhance the overall objective of the functions.

7 Claims, 11 Drawing Sheets

OTHER PUBLICATIONS

Herb Bridges, "*The Filming Of Gone With The Wind*," released Aug. 1, 1998, ISBN:0865546215 Mercer University Press, pp. 130-136.

Jeffrey Gettleman, "*All Their Profit Is On Paper, Entrepreneurs Carve Out Niche Supplying Cardvoard Extras*, " Los Angeles Times, Jun. 23, 1999 (2 pages).

Mark Edward Wilows, "*Making a killing with cardboard*, " Northwest Indiana News, Sunday, Jan. 15, 2000; pp. 1-4 http://www.nwitimes.com/articles/2000/01/16/export392424.txt.

Gregpak, "*FilmHelp Message Board*," http://www.gregpak.com/board/messages/176.html (Jun. 26, 2000) (one page).

Doctor Drew, "*Set Report on Sum Of All Fears—My Experience as an Action Movie Extra (or How I Died in a Nuclear Explosion at the Super Bow*," http://www.joblo.com/setreport-soaf.htm (no date given) (1 page).

Michael Wills, Jr., "*A Night as an Extra*, " Jul. 26, 2002, pp. 1-6 http://www.harlemlive.org/writing-art/memoir/beinamovie.html.

Andy Dehnart, "*Maddening Crowd*, " (no date given), pp1-3 http://articles.student.com/article/extrawaterboy.

"*Flubber*, " (6 pages) http://www.norcalmovies.com/Flubber/.

"*Picture News, Views Of The News*, " Hollywood Citizen News, Apr. 7, 1969. (no author cited) (1 page).

"*The Future*, " The Shuftan Process (date and author unavailable) (3 pages).

* cited by examiner

INFLATABLE HUMANOID FORMS

CROSS-REFERENCE TO RELATED APPLICATIONS

This application is a continuation of U.S. application Ser. No. 09/940,301, now U.S. Pat. No. 6,688,940, entitled, "Inflatable Humanoid Forms," filed on Aug. 27, 2001. The parent U.S. application Ser. No. 09/940,301 and divisional application Ser. No. 10/368,501, now U.S. Pat. No. 6,672,933, entitled, "Inflatable Humanoid Forms," filed on Feb. 15, 2003, both to the same inventor of record are herein incorporated by reference in their entirety.

FEDERALLY SPONSORED RESEARCH AND DEVELOPMENT

Not Applicable

REFERENCE TO A MICROFICHE APPENDIX

Not Applicable

FIELD OF INVENTION

The present invention relates to an apparatus for use in filming or photographing crowd scenes typically in stadium type settings. The apparatus consists of one or more inflatable humanoid figures, which are configured to fit into stadium type seating in varying locations so as to provide the illusion of a filled stadium or equivalent to a camera or video recorder. Other non-seated embodiments of the invention are included as well.

BACKGROUND OF INVENTION

The current art involving the filming of background crowd scenes for example, inside stadium or auditorium type seating requires that two-dimensional figures be placed as props in or near the seats. These props are generally constructed of cardboard or other similar materials, which are heavy, relatively inflexible, difficult to transport, time consuming to install and remove and are susceptible to wet or windy weather conditions.

Another disadvantage in using the cardboard props concerns the limited field of view provided by the two dimensional shapes. Movie and photographic scenes need to be reconfigured to avoid exposing the unfinished sides or rear of the props to the camera, thus incurring lost time and increasing production costs.

A further disadvantage concerns the amount of storage space required for the props. The cardboard cutout figures used in the current art are generally constructed of one or two life-sized components requiring multiple large storage boxes and correspondingly large amounts of storage space when not in use.

In other applications, inflatable mannequins are known in the art for use in modeling apparel as is disclosed by Miller U.S. Pat. No. 2,698,496, Wolf U.S. Pat. No. 3,028,058 and Gross U.S. Pat. No. 5,419,729; as a toy or doll as is disclosed by Hornsby U.S. Pat. No. 4,259,805 and Pietrafesa U.S. Pat. No. 6,030,271 and as motor vehicle security device Brown U.S. Pat. No. 5,367,294. However, none of the prior art teaches or suggests an inflatable humanoid figure for use as a prop in background scenes associated with motion picture, video, television or still photography.

SUMMARY

This invention provides an apparatus, which is used to provide three-dimensional human-like shapes as props to enhance the visual effect of large numbers of people typically required in crowd scenes in film, video and still photography. The invention comprises life-sized inflatable humanoid figures that resemble human beings and are constructed of lightweight plastic or similar elastomeric materials. The inflatable props include at least one rapid fill and relief valve situated in an inconspicuous location on the humanoid figure.

The use of life-sized inflatable humanoid figures allows the use of existing wardrobes, makeup and other accoutrements necessary for rendering a realistic visual effect. Other human attributes including apparel, facial, gender and racial characteristics may be incorporated into the invention at time of manufacture. Lastly, the humanoid figures may be manufactured in varying sizes and shapes to simulate the natural variations in human forms.

In the preferred embodiment, groupings of about four life-sized humanoid figures each comprising torso members, arm members, neck members and head members are contiguously connected together by narrow tubular sections located on one or more sides of the forms. The tubular sections permits inflation gas to flow into and out of each internal cavity of the props and also provides a means of anchoring the props in their proper seated positions.

The tubular sections are fabricated on the lower sides of the humanoid figures so as to be invisible to a camera when placed in a seated position. In situations where a smaller number of humanoid figures are required, it is envisioned that individual humanoid figures will be manufactured allowing selected placement between the multi-body forms and single body forms. Alternately, excess humanoid figures may be removed from the desired humanoid figures by cutting the interconnecting tubular sections and sealing the open end with a bonding agent, tape or clamp. The flexible nature of the invention allows installation in both standard and non-standard seating arrangements. In windy locations, it is envisioned that the props may be held in place by tape, adhesive, Velcro, weights, tie downs or other similar means.

In a second embodiment of the invention, life-sized humanoid figures each complete with feet, legs, torso, arms, neck and head are intended to be employed in background situations requiring human forms in non-seated backgrounds scenes. Other attributes of this embodiment of the invention are equivalent to those described in the preferred embodiment.

In a third embodiment of the invention, life-sized humanoid figures each complete with feet, legs and lower torso are intended to be employed in background situations requiring the lower portions of human forms in backgrounds scenes. Other attributes of this embodiment of the invention are equivalent to those described in the preferred embodiment.

DETAILED DESCRIPTION

This invention comprises one or more life-sized inflatable humanoid figures that resemble human forms. The humanoid figures are constructed of lightweight plastic or similar elastomeric materials. The inflatable props include at least one rapid fill and relief valve situated on the underside, side or rear of the humanoid figure assembly. In the preferred embodiment, single humanoid figures or groupings of about four life-sized humanoid figures each comprising torso members, arm members, neck members and head members are contiguously connected together by narrow tubular sections located on one or more sides of the forms. The tubular sections permits inflation gas to flow into and out of each internal cavity of the props and also provides a means of anchoring the props in their proper seated positions. The props are placed in background scenes and inflated. Additional wardrobe and other accoutrements may be included as necessary to conform to set requirements and to provide realistic background motion. The humanoid figures are placed into their seats with the necessary wardrobe typically intermingled with live actors or extras to provide a more realistic background setting. Filming of the humanoid figures occurs generally outside the focal range of the camera. Thus, the humanoid figures appear life-like to the camera and resulting viewing media.

Reviewing this specification in conjunction with the drawings facilitates a better understanding of the invention. Drawing tag reference numbers are replicated in the various views and embodiments of the invention. To the extent possible, drawing tag references numbers are discussed only once to limit prolixity of the specification.

Figure 1:
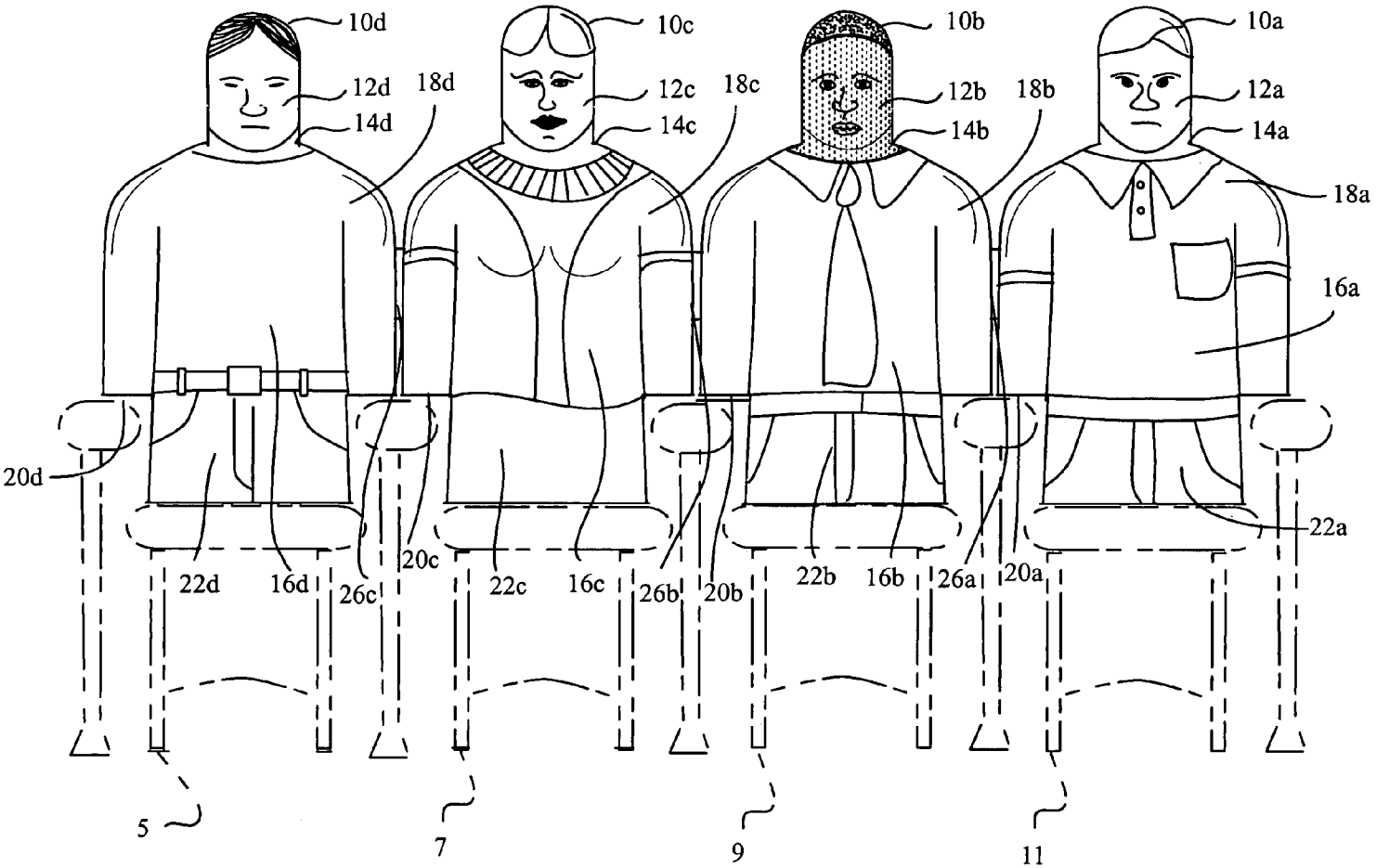
FIG. 1—FIG. 1 depicts a frontal view of the preferred embodiment of the invention where a plurality of humanoid figures configured for use in stadium type seating.

Referring to FIG. 1, a frontal view of the preferred embodiment of the invention is shown including about four humanoid FIGS. 10*a*, 10*b*, 10*c*, 10*d* for use in crowd scenes in which a seated position is advantageous. The humanoid figures in this embodiment are configured such that the consecutive arm sections 18*a*, 20*a*, 18*b*, 20*b*, 18*c*, 20*d* and gaps between each humanoid figure's waist section fit over the armrests of stadium type seating. The trunk portion of each humanoid FIG. 22*a*, 22*b*, 22*c*, 22*d* includes a laterally aligned bottom disposed below the waist which rests in the actual seat portion of the seat. In various embodiments of the invention, the left and right arm members each include a generally planar distal end disposed at approximately a right angle to the trunk (torso) portion of each humanoid figure's waist section.

In this embodiment of the invention, each humanoid figure is manufactured to include a contiguous gas-tight cavities 26*a*, 26*b*, 26*c*, 26*d* between adjacent humanoid figures, which allows inflating gas to fill the entire line of humanoid figures including the head members 10*a*, 10*b*, 10*c*, 10*d*, neck members 14*a*, 14*b*, 14*c*, 14*d*, left arm members 20*a*, 20*b*, 20*c*, 20*d* and right arm members 18*a*, 18*b*, 18*c*, 18*d* and torso members 22*a*, 22*b*, 22*c*, 22*d*.

Human characteristics such as hair, eyes, nose, mouth, eyebrows, ears, breasts and skin color may be included during the manufacturing process by applying a painting, pigmenting, silk screening or other coloring process. Alternately or in combination therewith, human characteristics and natural body contours may be included during the molding process to improve the human likeness.

Figure 2:
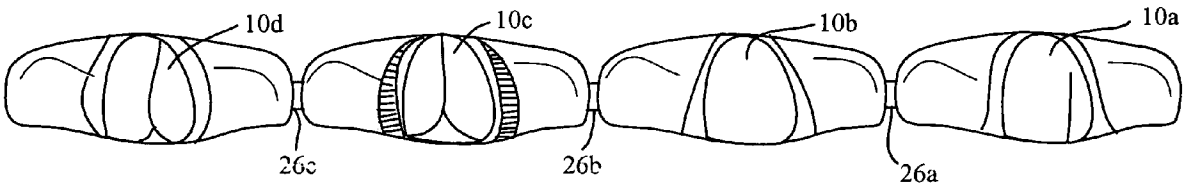
FIG. 2—FIG. 2 depicts a top view of the preferred embodiment of the invention.

Referring to FIG. 2, a top view of the preferred embodiment 10*a*, 10*b*, 10*c*, 10*d* is depicted illustrating the three dimensional aspect of the invention 24*a*, possible apparel designs and various human characteristics 12*a*. This view also illustrates the contiguous gas-tight cavities 26*a*, 26*b*, 26*c*, 26*d* between adjacent humanoid figures, which allows inflating gas to fill the entire line of humanoid figures.

Figure 3:
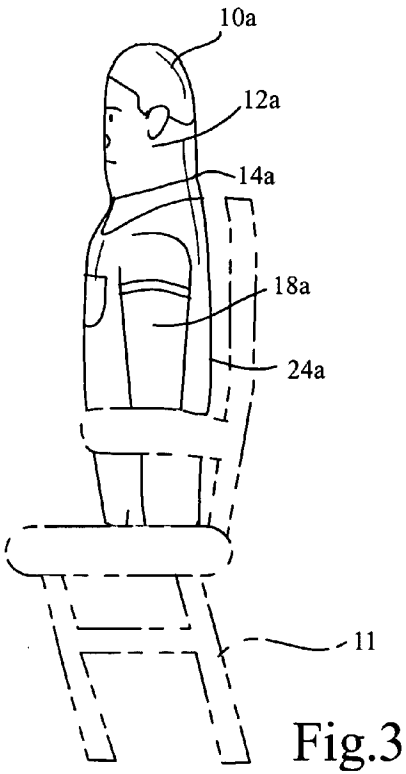
FIG. 3—FIG. 3 depicts a side view of the preferred embodiment of the invention.

Referring to FIG. 3, a side view of the preferred embodiment 10*a* is depicted which again illustrates the three dimensional aspect of the invention 24*a*, possible apparel designs and various human characteristics 12*a*.

Figure 4:
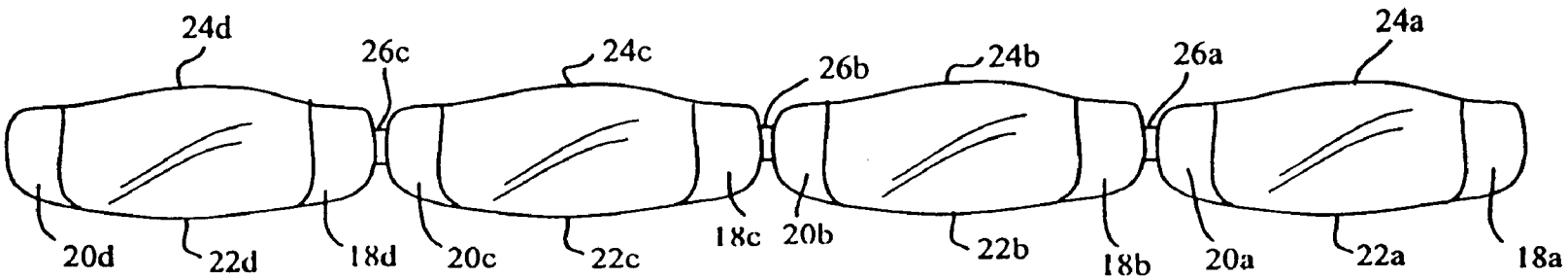
FIG. 4—FIG. 4 depicts a bottom view of the preferred embodiment of the invention.

Referring to FIG. 4, a bottom view of the preferred embodiment is depicted which illustrates the unit torso base member 22*a*, 22*b*, 22*c*, 22*d* and arm member spacing along with the contiguous gas-tight cavities 26*a*, 26*b*, 26*c*, 26*d*.

Figure 5:
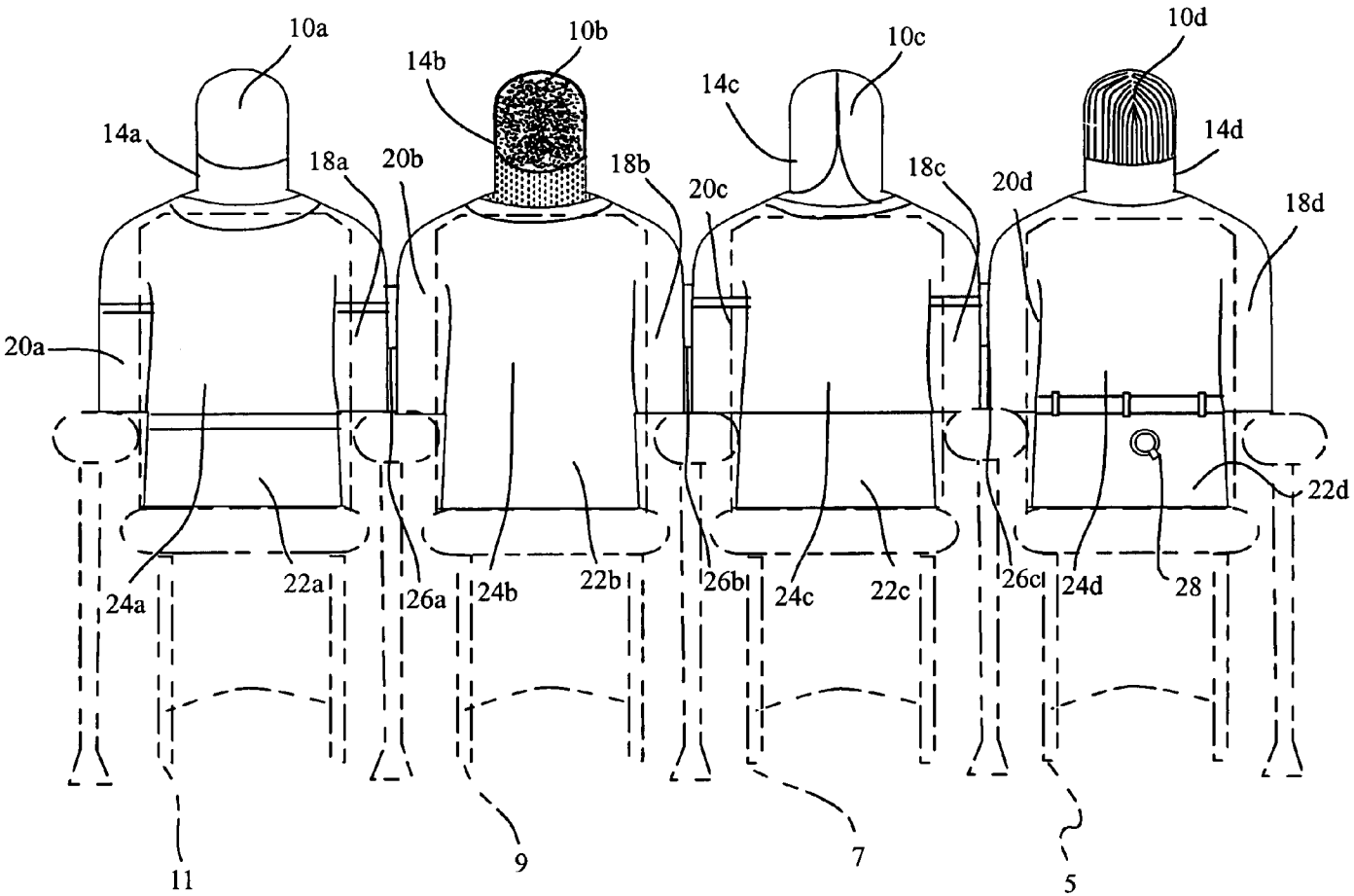
FIG. 5—FIG. 5 depicts a rear view of the preferred embodiment of the invention including a fill valve.

Referring to FIG. 5, a rear view of the preferred embodiment is depicted which illustrates the possible apparel and human characteristics 12*a*, 12*b*, 12*c*, 12*d* along with the contiguous gas-tight cavities 26*a*, 26*b*, 26*c*, 26*d* and a fill valve 28. A single fill valve 28 is depicted on the right most form for convenience only.

Figure 6:
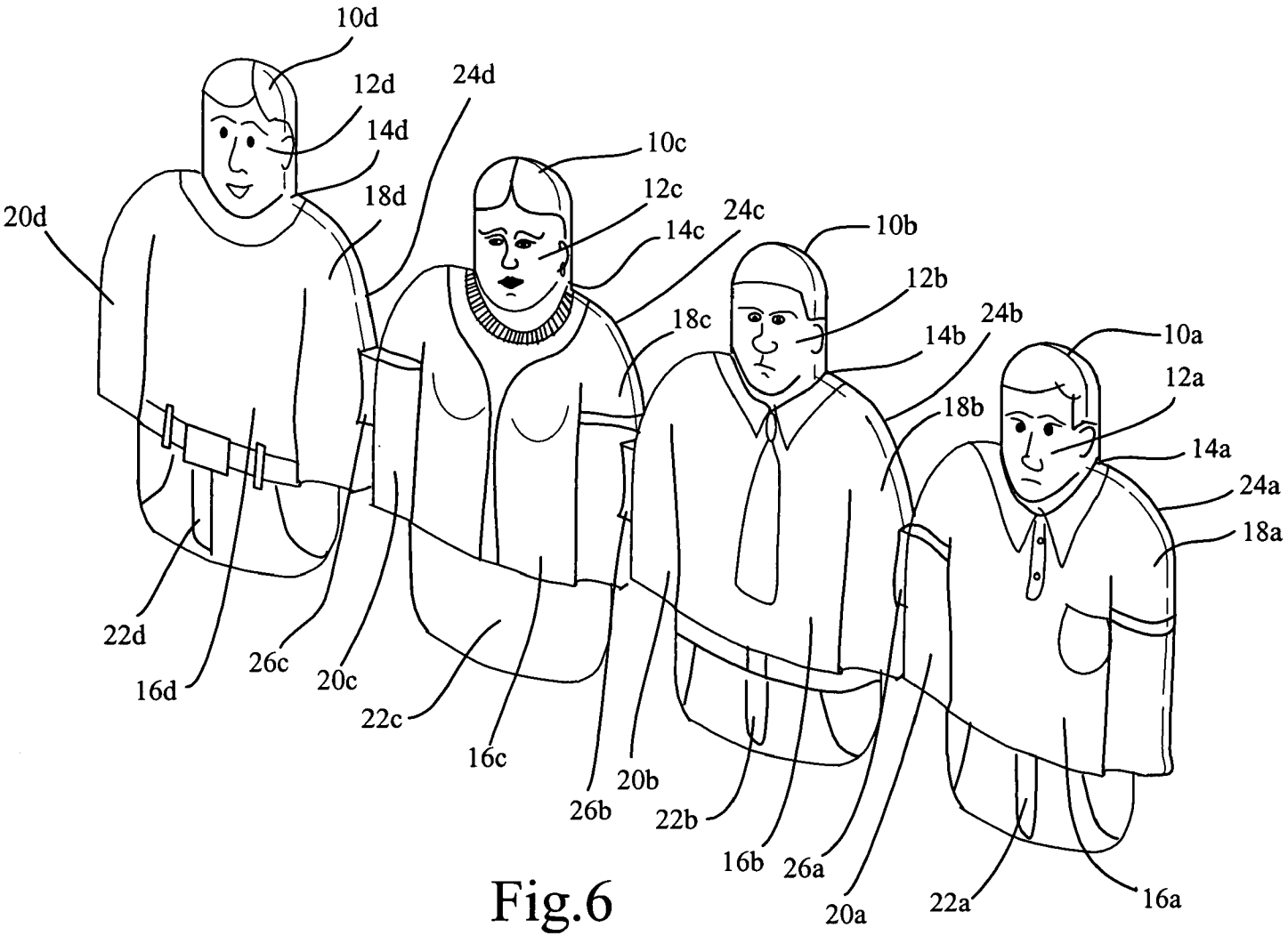
FIG. 6—FIG. 6 depicts a prospective view of the preferred embodiment.

Referring to FIG. 6, a perspective view of the preferred embodiment is depicted which illustrates the three dimensional nature 24*a*, 24*b*, 24*c*, 24*d* of the invention, possible apparel designs and various human characteristics 12*a*, 12*b*, 12*c*, 12*d*.

Figure 7:
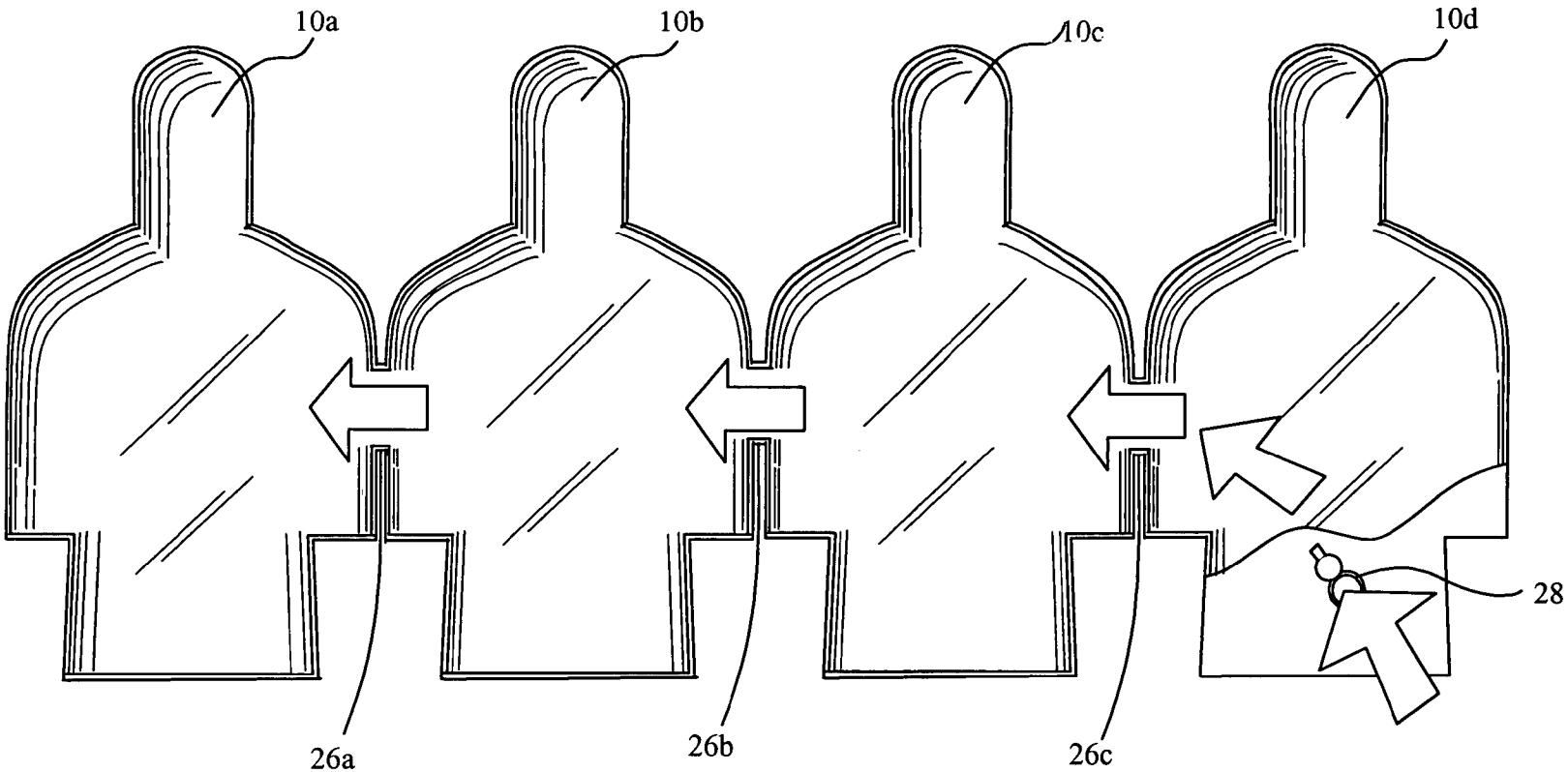
FIG. 7—FIG. 7 depicts filling of a plurality of humanoid figures through a fill valve.

Referring to FIG. 7, a diagrammatic view depicting the filling of contiguous internal chambers 26*a*, 26*b*, 26*c*, 26*d* through a fill valve 28, which inflates the humanoid FIGS. 10*a*, 10*b*, 10*c*, 10*d*. A single fill valve 28 is depicted on the rear of the right most form for convenience only. A fill valve 28 may be located on any of the forms in any inconspicuous location. Additional fill valves may be provided to allow faster inflation and deflation of the humanoid figures. The fill valves used for this invention are similar in design to those employed in camping style air mattresses which allows high volumes of air to flow into and out of the internal cavities of the humanoid figures.

Figure 8:
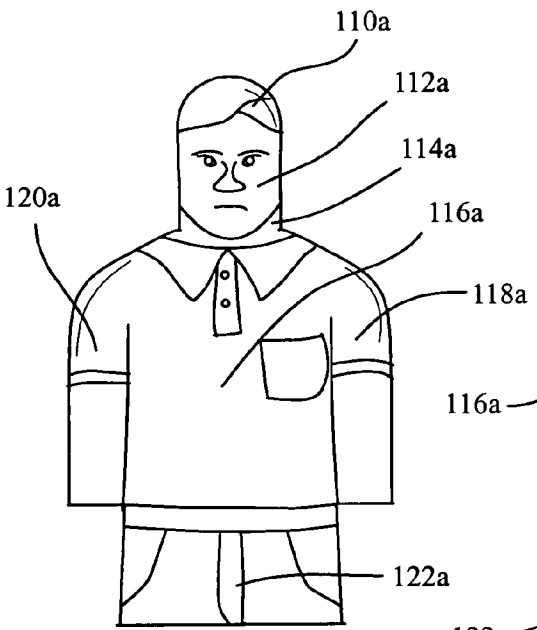
FIG. 8—FIG. 8 depicts a frontal view of the preferred embodiment where a single humanoid figure configured for use in stadium type seating.

Referring to FIG. 8, a front view of the single humanoid figure embodiment of the invention is depicted comprising a head member 110*a*, neck member 114*a*, left arm member 120*a* and right arm member 118*a* and a torso member 122*a*.

This embodiment of the invention allows individual humanoid figures to be placed in background scenes where it is desirable to employ one or more single humanoid figures, for example on a park bench that is visible in a background scene which may include an extra seated next to the humanoid figure. The single humanoid figure design is equivalent in all aspects to the multi-figure design other than the number of humanoid figures and contiguous gas-tight cavities.

Figure 9:
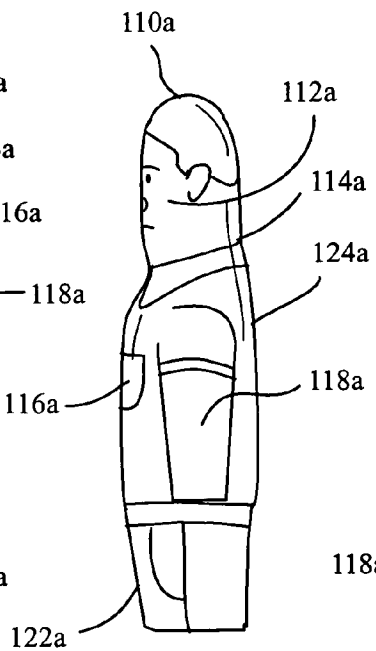
FIG. 9—FIG. 9 depicts a side view of the preferred embodiment of the single humanoid figure configured for use in stadium type seating.

Referring to FIG. 9, a side view of the single humanoid figure embodiment of the invention is depicted which again illustrates the three dimensional aspect of the invention 124*a*. As discussed in FIG. 8, the single humanoid figure design is equivalent in all aspects to the multi-figure design other than the number of humanoid figures.

Figure 10:
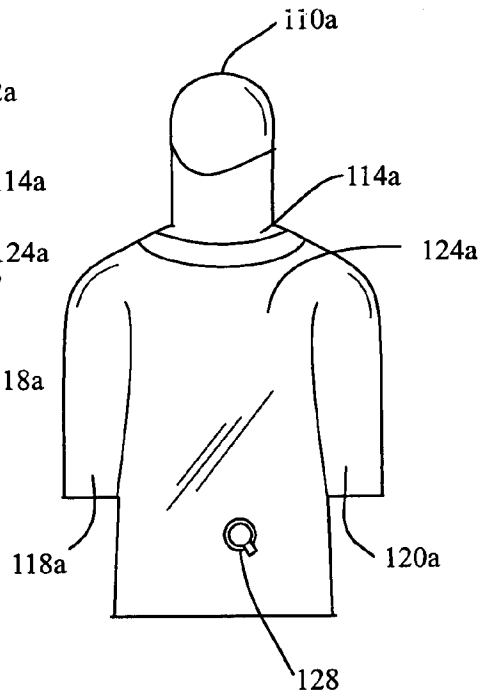
FIG. 10—FIG. 10 depicts a rear view of the preferred embodiment where a single humanoid figure configured for use in stadium type seating.

Referring to FIG. 10, a rear view 124*a* of the single humanoid figure embodiment of the invention is depicted. A fill valve 128 is shown on the rear of the individual humanoid figure for convenience only. The fill valve 128 may be located on any part of the humanoid figure, which would not be visible to a camera. All other aspects of the single humanoid figure are equivalent to the multi-figure units previously described.

Figure 11:
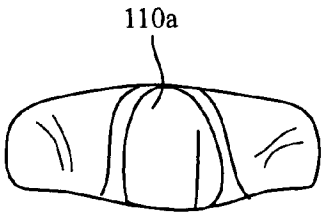
FIG. 11—FIG. 11 depicts a top view of the preferred embodiment where a single humanoid figure configured for use in stadium type seating.

Referring to FIG. 11, a top view 110*a* of the single humanoid figure embodiment of the invention is depicted. The single humanoid figure embodiment lack the contiguous gas-tight cavities included in the multi-figure units. All other aspects of the single humanoid figure are equivalent to the multi-figure units previously described.

Figure 12:
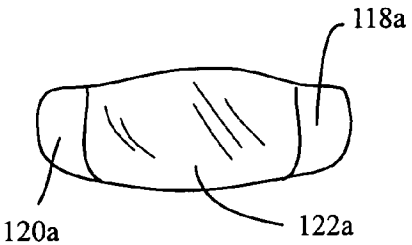
FIG. 12—FIG. 12 depicts a bottom view of the preferred embodiment where a single humanoid figure configured for use in stadium type seating.

Referring to FIG. 12, a bottom view 122*a* of the single humanoid figure embodiment of the invention is depicted. The single humanoid figure embodiment is designed to fit into stadium and/or auditorium style seating in a loose fit arrangement. The flexible nature of the humanoid figure's construction material allows use of the humanoid figure in non-standard seating arrangements. All other aspects of the single humanoid figure are equivalent to the multi-figure units previously described.

Figure 13:
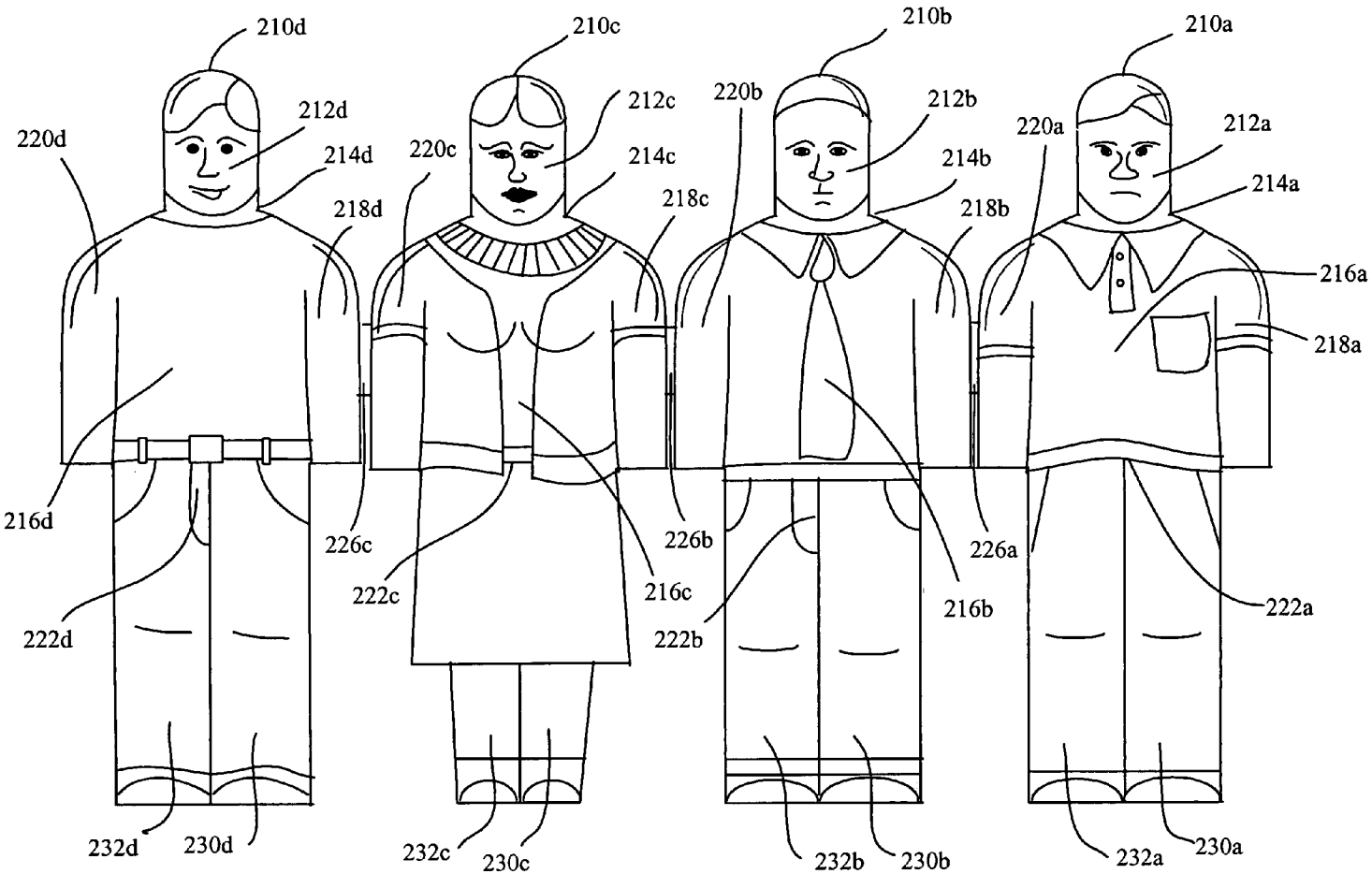
FIG. 13—FIG. 13 depicts a front view of the preferred embodiment where a plurality of humanoid figures configured for use where standing forms are desired.

Referring to FIG. 13, a frontal view of the preferred embodiment of the invention is shown including about four humanoid figures for use in crowd scenes in which a standing position and/or a full frontal view is advantageous. This embodiment comprises head members 210*a*, 210*b*, 210*c*, 210*d*, neck members 214*a*, 214*b*, 214*c*, 214*d*, left arm members 220*a*, 220*b*, 220*c*, 220*d* and right arm members 218*a*, 218*b*, 218*c*, 218*d*, torso members 222*a*, 222*b*, 222*c*, 222*d* and left leg members 232*a*, 232*b*, 232*c*, 232*d* and right 230*a*, 230*b*, 230*c*, 230*d* leg members.

Human characteristics 212*a*, 212*b*, 212*c*, 212*d* such as hair, eyes, nose, mouth, eyebrows, ears, breasts and skin color may be included during the manufacturing process by applying paint, adding pigments to the polymers, silk screening or other coloring process. The humanoid figures may be supported by tape, adhesive, Velcro, weights, tie downs or other similar means. All other aspects of the standing humanoid figures are equivalent to the multi-figure seated units previously described.

Figure 14:
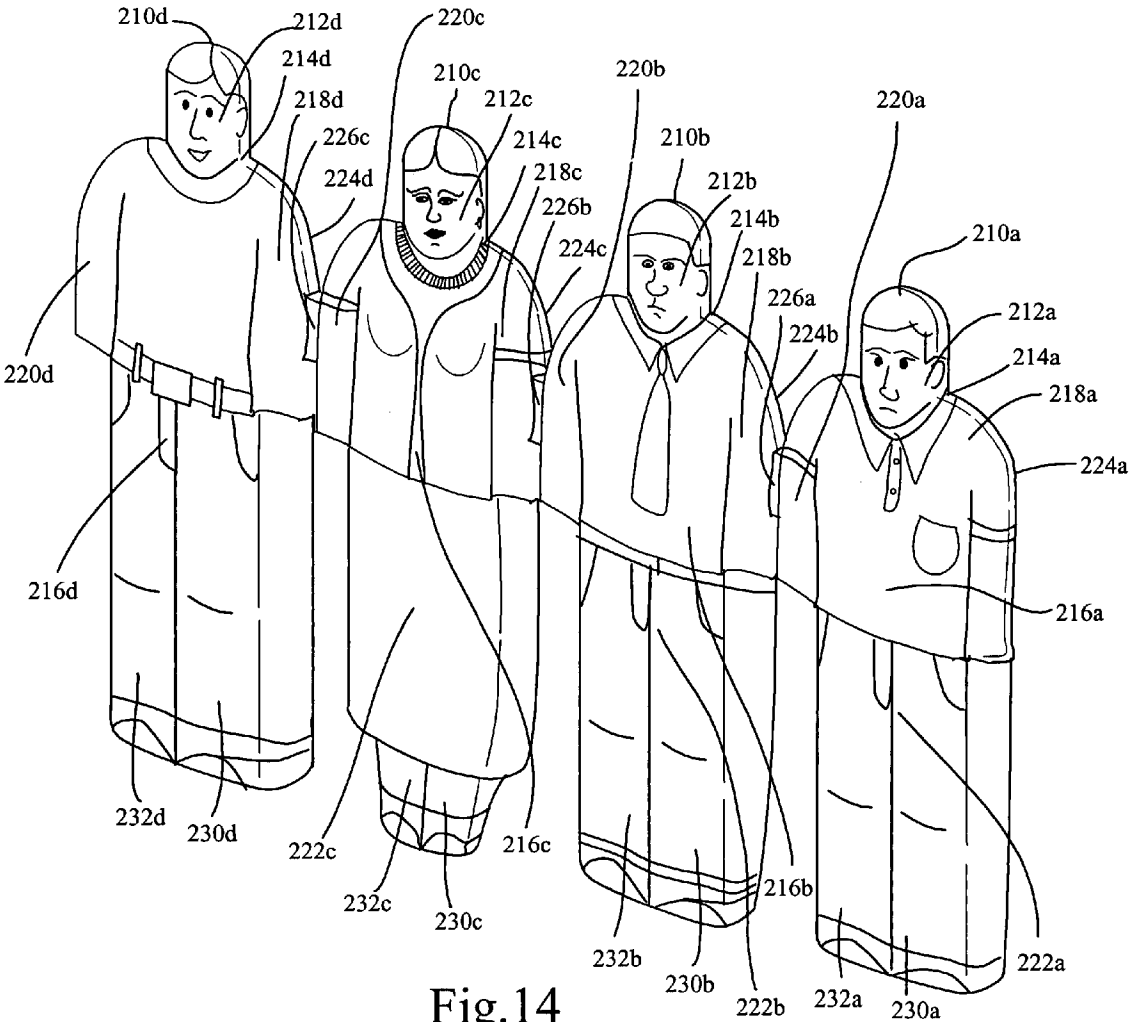
FIG. 14—FIG. 14 depicts a perspective view of the preferred embodiment where a plurality of humanoid figures configured for use where standing forms are desired.

Referring to FIG. 14, a perspective view of the another embodiment of the invention is shown including about four complete humanoid forms for use in crowd scenes in which a standing position and/or a full frontal view is advantageous. This view again illustrates the three dimensional nature 224*a*, 224*b*, 224*c*, 224*d* of the invention, which allows a greater range for viewing by a camera over the prior art cardboard cutout figures. A side view of this embodiment of the invention is omitted since its appearance is similar to the views shown in FIG. 3 and FIG. 9 with the inclusion of legs 230*a*, 232*a*, 230*b*, 232*b*, 230*c*, 232*c*, 230*d*, 232*d* and possible shoe and apparel designs. All other aspects of the standing humanoid figures are equivalent to the multi-figure seated units previously described.

Figure 15:
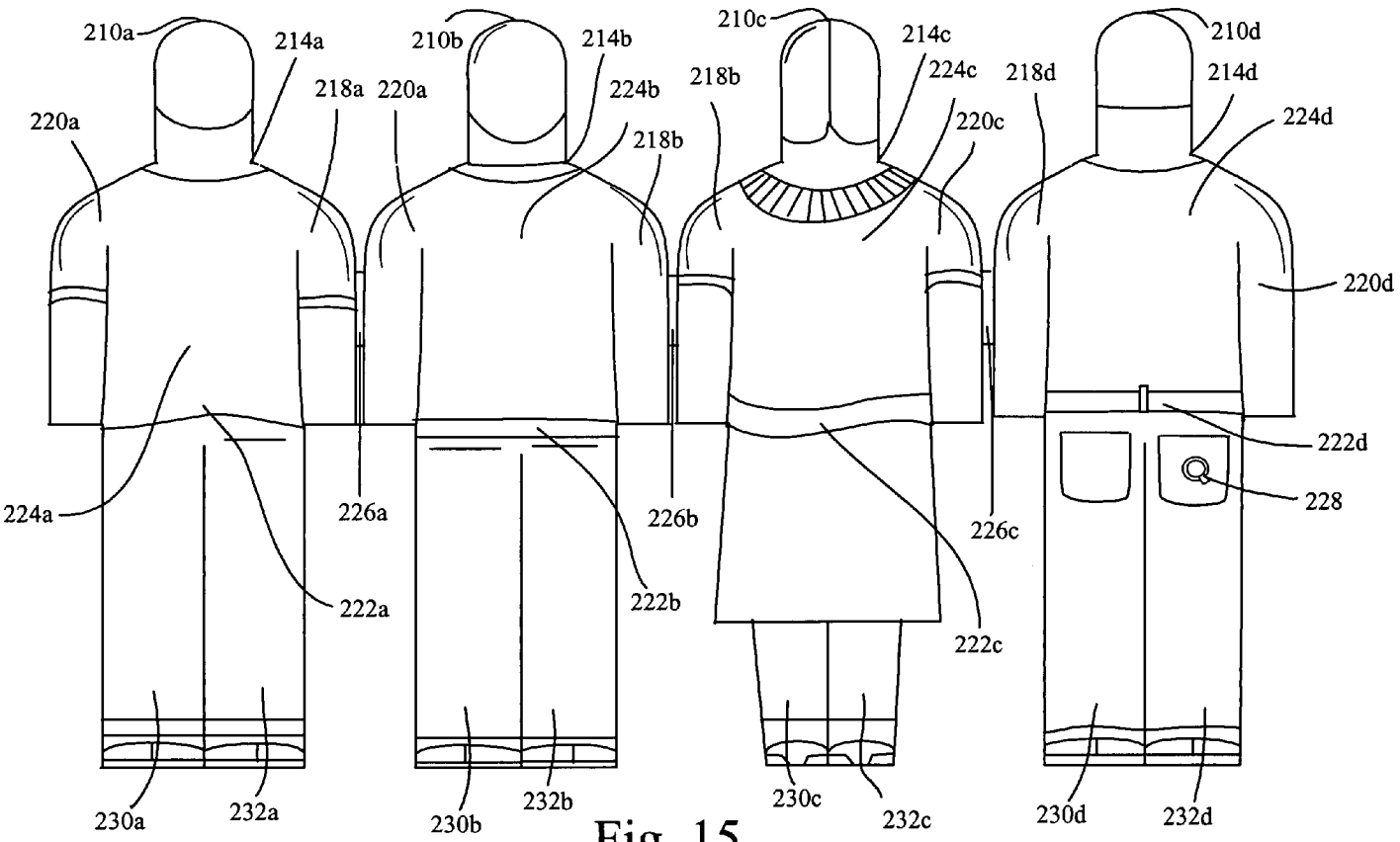
FIG. 15—FIG. 15 depicts a rear view of the preferred embodiment where a plurality of humanoid figures configured for use where standing forms are desired.

Referring to FIG. 15, a rear view 224*a*, 224*b*, 224*c*, 224*d* of the preferred embodiment of the invention is shown including about four complete humanoid forms for use in crowd scenes in which a standing position and/or a full frontal view is advantageous. This view again illustrates the three dimensional nature of the invention which allows a greater range for viewing by a camera over the prior art cardboard cutout figures. All other aspects of the standing humanoid figures are equivalent to the multi-figure seated units previously described.

Figure 16:
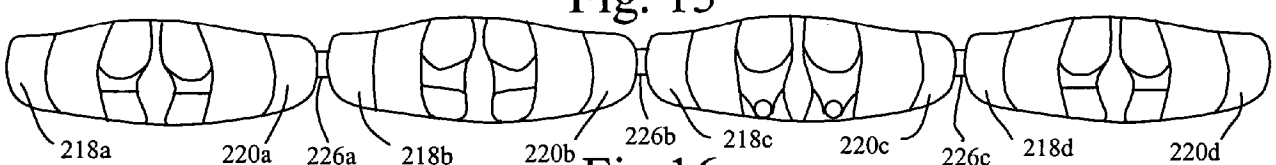
FIG. 16—FIG. 16 depicts a bottom view of the preferred embodiment where a plurality of humanoid figures configured for use where standing forms are desired.

Referring to FIG. 16, a bottom view of the preferred embodiment of the invention is shown including about four complete humanoid forms for use in crowd scenes in which a standing position and/or a full frontal view is advantageous. This view illustrates the base of each humanoid figure included in this embodiment of the invention, which allows the humanoid figures to be configured in standing positions by anchoring the base of one or more of the humanoid figures using the methods previously described. Also shown is the contiguous gas-tight cavities 226*a*, 226*b*, 226*c*, 226*d*.

Figure 17:
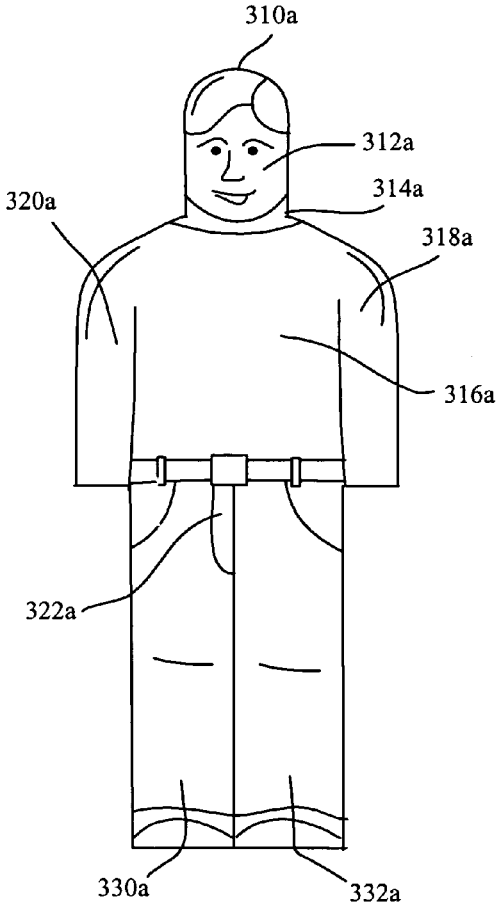
FIG. 17—FIG. 17 depicts a front view of the preferred embodiment where a single humanoid figure is configured for use where a standing form is desired.

Referring to FIG. 17, a frontal view of another embodiment of the invention is shown including a single complete form for use in crowd scenes in which a standing position and/or a full frontal view is advantageous. This embodiment of the invention comprises a head member 310*a* a neck member 314*a* left 320*a* and right arm members 318*a* a torso member 322*a* and left 332*a* and right 330*a* leg members.

Human characteristics 312*a* such as hair, eyes, nose, mouth, eyebrows, ears, breasts and skin color may be included during the manufacturing process by applying paint, pigmenting, silk screening or other coloring process. Other than the lack of adjoining contiguous gas-tight cavities and adjacent humanoid figures, all other aspects of the standing humanoid figures are equivalent to the multi-figure standing humanoid figures previously described.

Figure 18:
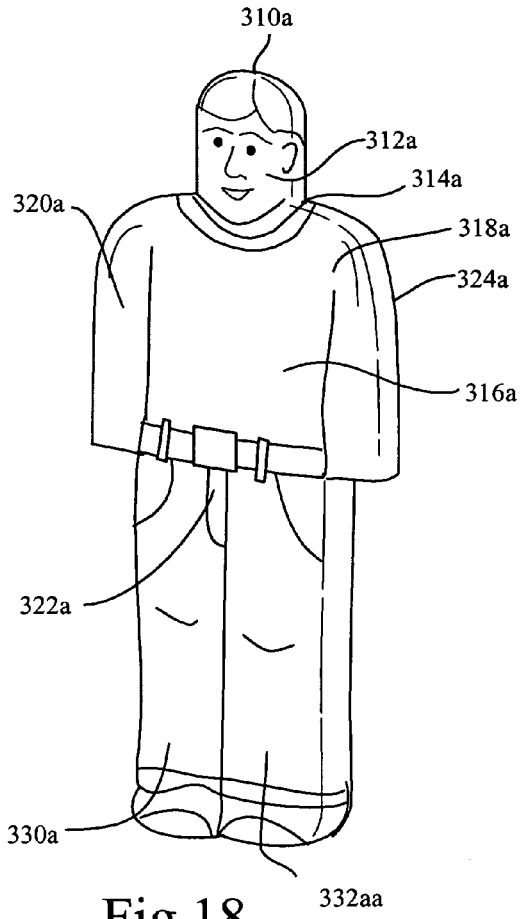
FIG. 18—FIG. 18 depicts a perspective view of the preferred embodiment where a single humanoid figure is configured for use where a standing form is desired.

Referring to FIG. 18, a perspective view of the preferred embodiment of the invention is shown including a single form for use in crowd scenes in which a standing position and/or a full frontal view is advantageous. This view again illustrates the three dimensional nature 324*a* of the invention, which allows a greater range for viewing by a camera over the prior art cardboard cutout figures. Other than the lack of adjoining contiguous gas-tight cavities and adjacent humanoid figures, all other aspects of the standing humanoid figures are equivalent to the multi-figure standing units previously described.

Figure 19:
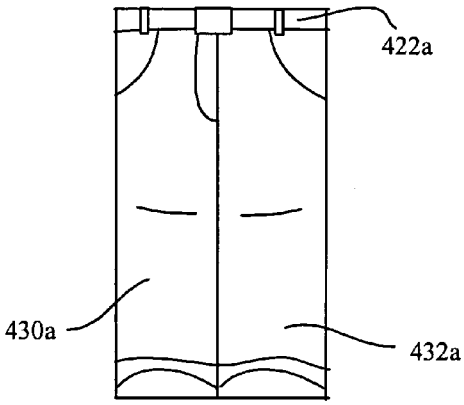
FIG. 19—FIG. 19 depicts a perspective view of the preferred embodiment where a lower torso including legs is desired.

Referring to FIG. 19, a frontal view of another preferred embodiment of the invention is shown comprising a single lower torso member 422*a*, left 430*a* and right leg 432*a* members. This embodiment of the invention is used in situations where only the lower portions of a human body are advantageous. All other aspects of the lower portions of this embodiment are equivalent to the single standing humanoid figure unit previously described. Top, perspective, side and bottom and multiple grouping views of this embodiment of the invention have been omitted as previously described views adequately cover the features associated with inventive embodiment.

Figure 20:
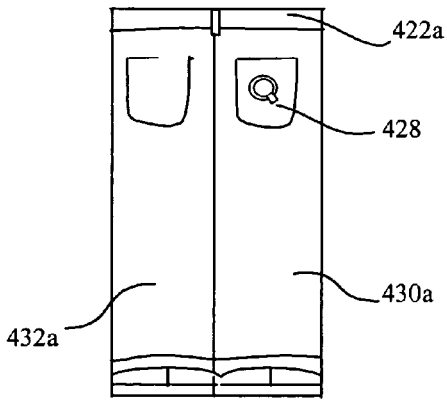
FIG. 20—FIG. 20 depicts a rear view of the preferred embodiment where a lower torso including legs is desired.

Referring to FIG. 20, a rear view of the preferred embodiment of the invention is shown illustrating the location of a fill valve 428. As previously discussed, the fill valve may be located on other inconspicuous parts of the humanoid figure. All other aspects of the standing humanoid figures are equivalent to the multi-figure seated units previously described.

Filming of the humanoid figures occurs generally outside the focal range of the camera. Thus, the humanoid figures appear life-like to the camera and resulting viewing media. The visual recording media productions includes visual recordings of a corporate training session, a lecture, a video media production, television programs, motion pictures, still photography, advertising, corporate conventions or cinematographic productions video productions, television programs, motion pictures, still photography, advertising, corporate conventions or cinematographic productions. For the seated version, the inflatable humanoid figures are placed into one or more seats in a background scene. The seats include a park bench, stadium and/or auditorium style seating. In windy locations, it is envisioned that the inflatable humanoid figures may be held in place by tape, adhesive, Velcro, weights, tie downs or other similar means.

For the standing version of the life-sized humanoid figures, each complete with feet, legs, torso, arms, neck and head are placed in background scenes where a standing position and/or a full frontal view is advantageous. The humanoid figures are supported in standing positions by anchoring the base of one or more of the humanoid figures using tape, adhesive, Velcro, weights, tie downs or other similar means. Excess humanoid figures may be removed from the desired humanoid figures by cutting the interconnecting tubular sections and sealing the open end with a bonding agent, tape or clamp.

The foregoing described embodiments of the invention are provided as illustrations and descriptions. They are not intended to limit the invention to precise form described. In particular, it is contemplated that functional implementation of the invention described herein may be implemented in any visual recording media requiring simulated participants including corporate training session, lectures, video media and film media productions and still photography. Other variations and embodiments are possible in light of above teachings, and it is not intended that this Detailed Description limit the scope of invention.

What is claimed is:

1. A three-dimensional apparatus for use in simulating a crowd of real people seated in stadium or auditorium style seating and viewing a particular event in a foreground scene, the plurality of three-dimensional apparatus for use in background crowd scenes in visual recording media productions, the three-dimensional apparatus comprising:

a plurality of inflatable life-sized humanoid figures, each of said inflatable humanoid figures including;

a head member;

a neck member contiguously connecting said head member to a torso member;

said torso member including;

a waist, a left side, a right side; and an interior surface which forms a gas-tight cavity contiguous with said head member, said neck member, and said torso member wherein said gas-tight cavity of one of the inflatable life-sized humanoid figures is contiguously connected to the gas-tight cavity of another of the inflatable life-sized humanoid figures by one or more narrow tubular sections situated between adjacent humanoid figures which allows inflating gas to fill an entire line of humanoid figures; and wherein the plurality of inflatable life-sized humanoid figure is shaped such that the plurality of inflatable life-sized humanoid figures, when placed in adjacent stadium or auditorium style seating, simulates a crowd of real people viewing the particular event in the foreground scene when visually recorded in a manner that does not capture a clear image of the plurality of inflatable life-sized humanoid figures as compared to the foreground scene.

2. The apparatus according to claim 1 further including means for supporting or anchoring said at least one life-sized inflatable humanoid figure in an auditorium style seat or a stadium style seat.

3. The apparatus according to claim 1 further including;

a right leg member including;

a first upper end contiguously connected to a right bottom edge of said torso member, a first lower end contiguously connected to a right foot member, and a right leg interior surface;

a left leg member including;

a second upper end contiguously connected to a left bottom edge of said torso member, a second lower end contiguously connected to a left foot member; and a left leg interior surface; and, wherein said right and left leg interior surfaces form a second gas-tight cavity contiguous with said gas tight cavity.

4. The three-dimensional apparatus according to claim 1 wherein at least one inflatable humanoid figure further includes human characteristic means.

5. The three-dimensional apparatus according to claim 4 wherein said human characteristic means includes at least one of hair feature means, gender feature means, racial feature means or facial feature means.

6. The three-dimensional apparatus according to claim 1 wherein at least one of said plurality of inflatable humanoid figures further includes apparel means.

7. The apparatus according to claim 6 wherein said apparel means includes wardrobe means, makeup means or other accoutrement means.

* * * * *